US008516635B2

(12) United States Patent
Hsu

(10) Patent No.: US 8,516,635 B2
(45) Date of Patent: Aug. 27, 2013

(54) MATTRESS STRUCTURE ABLE TO ADJUST ELASTIC SUPPORT FORCES

(76) Inventor: Han-Chung Hsu, Taipei (TW)

( * ) Notice: Subject to any disclaimer, the term of this patent is extended or adjusted under 35 U.S.C. 154(b) by 408 days.

(21) Appl. No.: 13/028,324

(22) Filed: Feb. 16, 2011

(65) Prior Publication Data

US 2012/0054968 A1 Mar. 8, 2012

Related U.S. Application Data

(63) Continuation of application No. 12/877,275, filed on Sep. 8, 2010, now Pat. No. 7,934,277.

(51) Int. Cl.
*A47C 23/06* (2006.01)

(52) U.S. Cl.
USPC ..... 5/600; 5/697; 5/936

(58) Field of Classification Search
USPC ..... 5/690, 716, 697, 936, 727; 267/177, 267/170
See application file for complete search history.

(56) References Cited

U.S. PATENT DOCUMENTS 6,003,178 A * 12/1999 Montoni ..... 5/690
6,487,738 B1 * 12/2002 Graebe ..... 5/719
2008/0276377 A1 * 11/2008 Hsu ..... 5/727

* cited by examiner

*Primary Examiner* — Fredrick Conley
(74) *Attorney, Agent, or Firm* — Ming Chow; Sinorica, LLC

(57) ABSTRACT

A mattress structure able to adjust elastic support forces comprises: a fixed plate, which has a plurality of flexible accommodating holes and a plurality of first flexible members and is fixed in the mattress body, the flexible accommodating holes are at the bottom of the first flexible members respectively; a moving plate, which has a plurality of second flexible member corresponding to the flexible accommodating hole, the moving plate is below the fixed plate; and a support plate, which is below the moving plate and has an air compressor at the bottom thereof, the air compressor has a plurality of air bags disposed between the support plate and the moving plate and a plurality of tubes connecting the air compressor with the air bags, the moving plate is thus moved up and down through that the air bags pump gas.

7 Claims, 7 Drawing Sheets

MATTRESS STRUCTURE ABLE TO ADJUST ELASTIC SUPPORT FORCES

CROSS REFERENCE TO RELATED APPLICATION

This application is a Continuation-in-part of Ser. No. 12/877,275, filed Sep. 8, 2010 now U.S. Pat. No. 7,934,277, all of which is incorporated herein by reference.

BACKGROUND OF THE INVENTION

1. Field of the Invention

The present invention generally relates to a mattress structure able to adjust elastic support forces, more particularly to a mattress structure that is adjustable in the field of support forces in order to provide different support forces for different users.

2. Description of the Prior Art

Under the leadership of science and technology, the life is always fast and in pressure. At the end of a day, everybody needs a good sleep to completely relax the body for the next day.

Except for work and normal life, 30% time is for sleep for a human being. The quality of a sleep may directly affect the health of the human being. Accordingly, demands to a mattress may then be more than ever. The prior mattresses are mostly made by the way of integration molding, and the softness of a mattress shall be adjusted based on the requirements of a user. It costs a lot as always and is inconvenient. The prior mattress structure has a mattress body and a flexible member in the mattress body, but it is full of disadvantages listed below:

1. After using a period of time, partial of the flexible member is damaged as a sunken portion so as to affect sleep.
2. The flexibility of each part of the surface of the prior mattress structure is the same and may not be changed; the flexibility cannot be adjusted according to different users as well.
3. Since the flexible member is made by integration molding, a chain reaction can happen. If two people with different sleep habits lie on a bed, one people may be affected by another. Hence, an option for solving the problem is to purchase another mattress structure for more comfortable, but it is definitely not an economic way.

Thereby, to develop a new type of mattress structure is an issue for the skilled persons in the art and may be discussed hereinafter.

SUMMARY OF THE INVENTION

The main objective of the present invention is to provide a mattress structure able to adjust elastic support forces, the mattress structure can adjust the positions of a moving plate moving up and down in order to adjust the elastic support forces of the mattress. The feature of adjustable elastic support forces of the present invention is to serve different users. That is, the lowering magnitude of the mattress can be controlled while a user lies on the mattress.

To reach above objective, the mattress structure able to adjust elastic support forces comprises: a fixed plate 2, which has a plurality of flexible accommodating holes 22 and a plurality of first flexible members 21 and is fixed in the mattress body, the flexible accommodating holes 22 are at the bottom of the first flexible members 21 respectively; a moving plate 3, which has a plurality of second flexible member 31 corresponding to the flexible accommodating hole, the moving plate 3 is below the fixed plate 2; and a support plate 5, which is below the moving plate 3 and has an air compressor 52 at the bottom thereof, the air compressor 52 has a plurality of air bags 53 disposed between the support plate 5 and the moving plate 3 and a plurality of tubes 54 connecting the air compressor 52 with the air bags 53, the moving plate 3 is thus moved up and down through that the air bags 53 pump gas.

The air bags 53 inflated by that the air compressor 52 pumps air moves the moving plate 3 up to the fixed plate 2, the second flexible members 31 then penetrate through the flexible accommodating holes 22 and move up. Meanwhile, not only the first flexible members 21 are to support the user, but also the second flexible members 31 do. Hence, the support forces are enhanced; otherwise, to activate the air compressor 52 to leak the air bags 53 is to lower down the moving plate 3, then the second flexible members 31 are lowered down either so as to make that only the first flexible members 21 support the user. That is, the support forces are decreased.

Preferably, the flexible accommodating holes 22 are not only disposed at the bottom of the first flexible members 21, but also disposed between first flexible members 21. So that when the second flexible members 31 move up through the moving plate 3, the support forces of the mattress structure are still controllable due to that each flexible accommodating hole 22 is between two first flexible members 21.

Preferably, the air compressor 52 is disposed outside of the mattress structure.

Preferably, the air bags 53 are disposed symmetrically.

Preferably, a flexible layer is disposed on the surface of the first flexible member 21, a package wraps around the mattress.

Preferably, the air compressor 52 is connected with a remote receiver and a remote radiator, the remote radiator is capable of radiating signals to the remote receiver for a user controlling the air compressor 52.

Preferably, a gap between the first flexible member 21 and the second flexible member 31 is disposed a guiding member.

Preferably, the support plate 5 has a plurality of fixing pillars 55, the fixing pillars 55 are actively penetrated through the moving plate 3 for the moving plate 3 steadily moving.

Preferably, a height sensor 6 is disposed between the moving plate 3 and the fixed plate 2 and connected with the air compressor 52, the message of the distance between the moving plate 3 and the fixing plate 2 is delivered to the air compressor 52 for controlling the displacement of the moving plate 3.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

Figure 1:
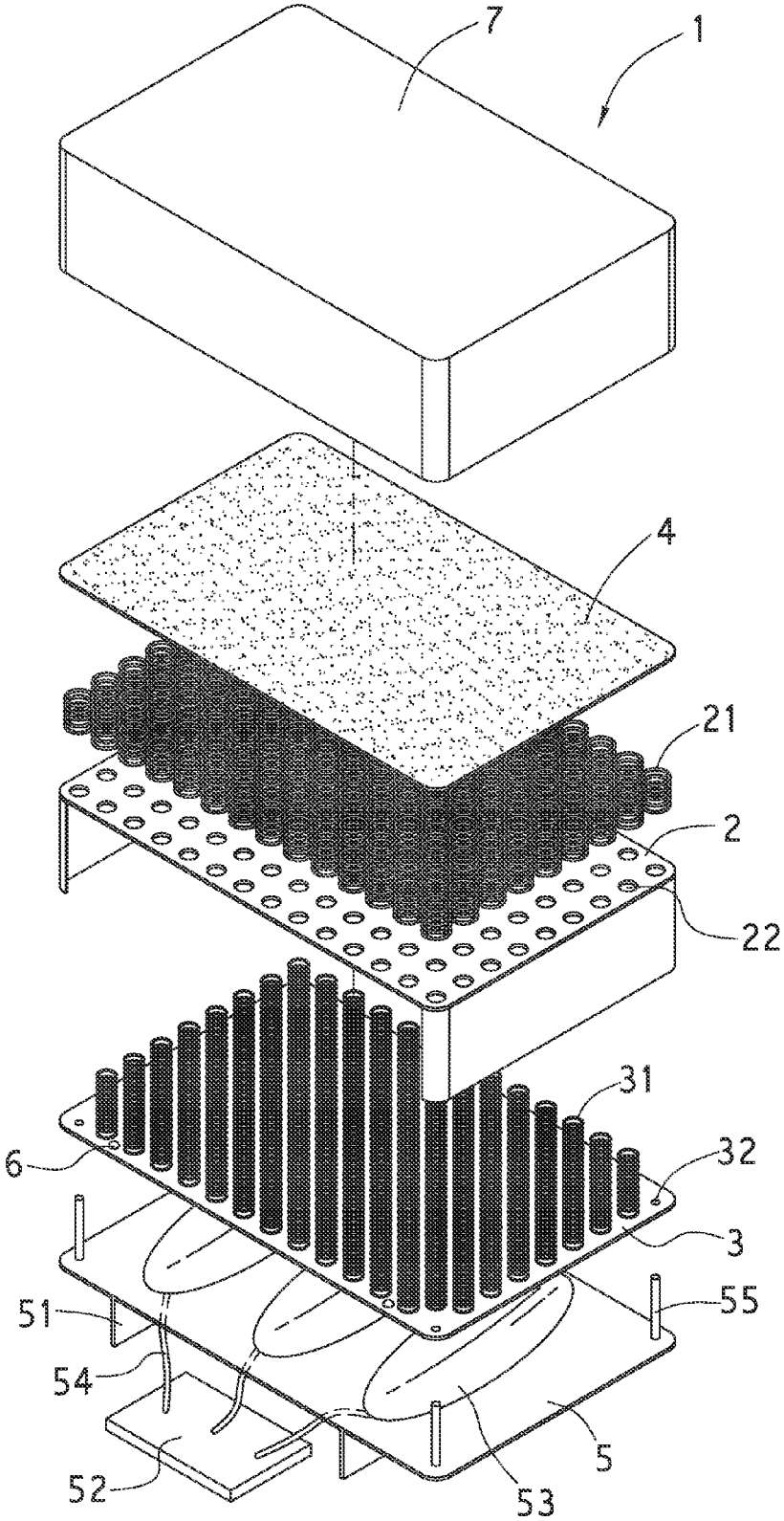
FIG. 1 illustrates a schematic 3-D exploded view of a mattress structure able to adjust elastic support forces of the present invention.
Figure 2:
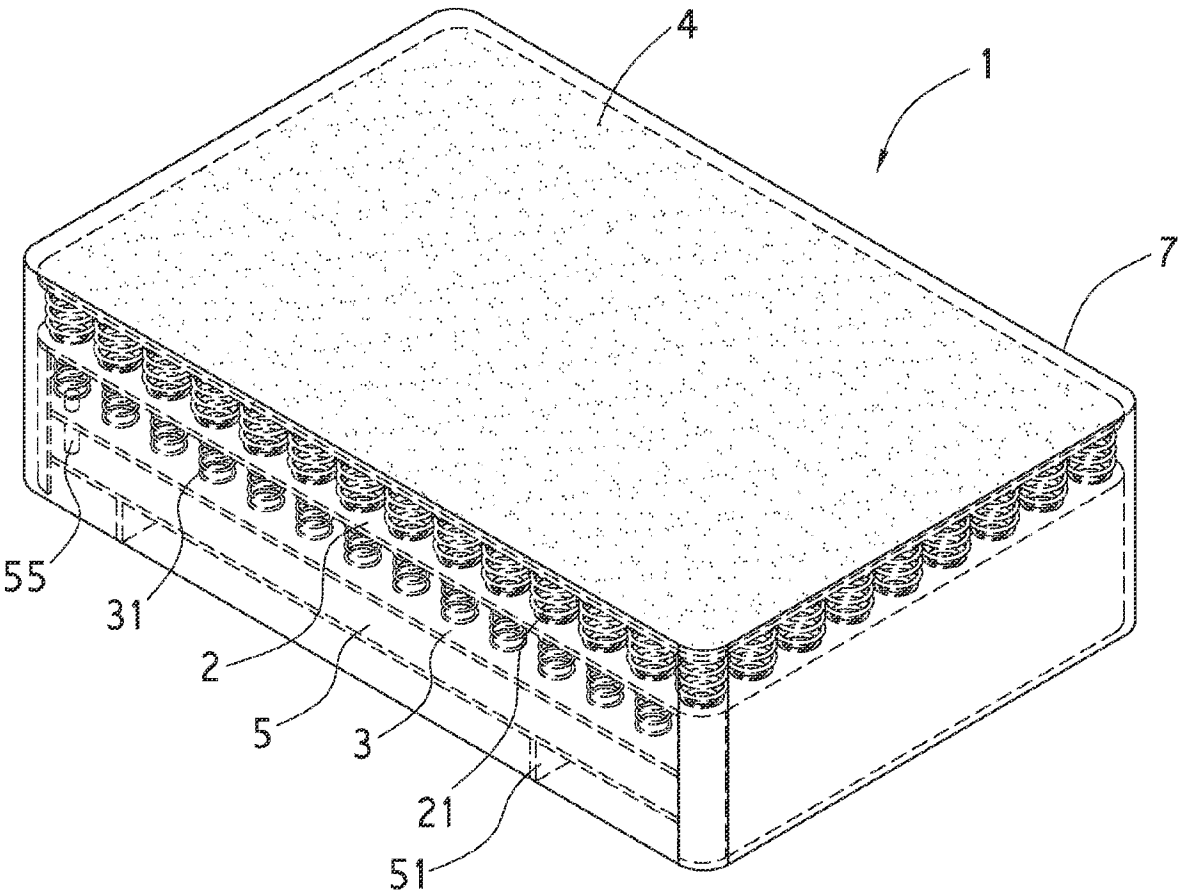
FIG. 2 illustrates a schematic 3-D assembled view of the mattress structure able to adjust elastic support forces of the present invention.
Figure 3:
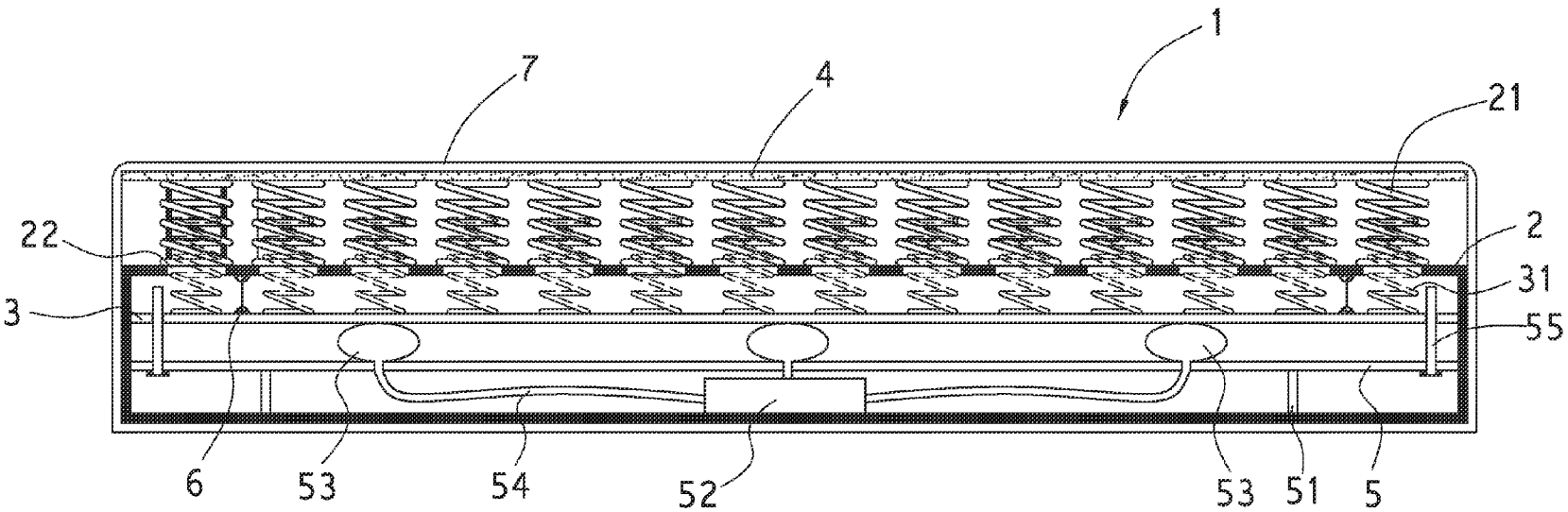
FIG. 3 illustrates a schematic action sectional view of the mattress structure able to adjust elastic support forces of the present invention.

With references to FIG. 1 to FIG. 3, which illustrate a schematic 3-D exploded view of a mattress structure able to adjust elastic support forces of the present invention, a schematic 3-D assembled view of the mattress structure able to adjust elastic support forces of the present invention and a schematic sectional view of the mattress structure able to adjust elastic support forces of the present invention. The mattress structure able to adjust elastic support forces is a mattress body 1, which includes:

a fixed plate 2, which is disposed in the mattress body 1 and has a plurality of flexible accommodating holes 22, the outer rim of the top surface of each flexible accommodating hole 22 is combined with a first flexible member 21, the flexible accommodating hole 22 is thus corresponding to the space of the first flexible member 21 and disposed at the bottom inside the first flexible members 21 or between the two first flexible member 21;

a moving plate 3, which has a plurality of second flexible members 31 corresponding to the flexible accommodating holes 22 of the fixed plate 2, the moving plate 3 is below the fixed plate 2, the second flexible member 31 is able to move upwardly from the internal of first flexible member 21, the moving plate 3 further has a plurality of positioning holes 32;

a flexible layer 4, which is disposed on the surface of the first flexible member 21;

a support plate 5, which is below the moving plate 3, two support legs 5 are to support and fix the support plate 5, and the support plate 5 has an air compressor 52 at the bottom thereof, the air compressor 52 has a plurality of air bags 53 disposed between the support plate 5 and the moving plate 3 and a plurality of tubes 54 connect the air compressor 52 with the air bags 53, the air compressor 52 then pumps air to the air bags 53, the peripheral of the support plate 5 has a plurality of fixing pillars 55 penetrating through the positioning holes 32 in order to let the moving plate 3 be moved up and down steadily, further, the air compressor 52 can be connected with a remote control device (not shown in the figure), which has a remote receiver and a remote radiator (not shown in the figure), the remote receiver is electrically connected with the air compressor 52 and receives the signals from the remote radiator so as to control the motor 51, the remote radiator is capable of radiating the signals of activation, lifting and lowering to the remote receiver for a user controlling the air compressor 52, the air bags 53 are disposed symmetrically for the stability while the air bags 53 are working;

a plurality of height sensors 6, which are disposed between the moving plate 3 and the fixed plate 2 and connected with the air compressor 52, the message of the distance between the moving plate 3 and the fixing plate 2 being delivered to the air compressor 52 for controlling the displacement of the moving plate 3;

a package 7, which wraps around the fixed plate 2, the first flexible members 21, the moving plate 3, the second flexible member 31, the support plate 5, and the air compressor 52.

Figure 4:
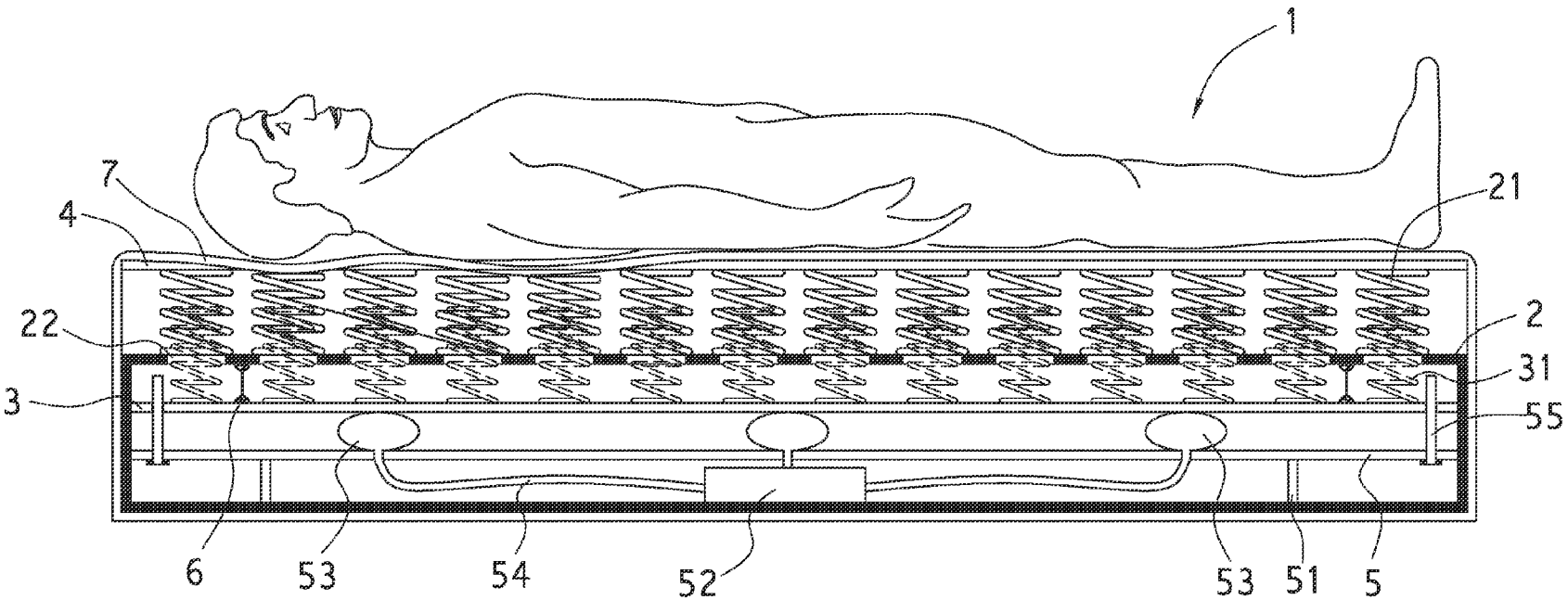
FIG. 4 illustrates a schematic sectional action view of the mattress structure able to adjust elastic support forces of the present invention.

With reference to FIG. 4, which illustrates a schematic sectional view of the mattress structure able to adjust elastic support forces of the present invention. While the user lies on the mattress, the body of the user touches the package 7 and the flexible layer 4 to deform the first flexible members 21, and the elastic support forces are provided for achieving the effect of the mattress structure.

Figure 5:
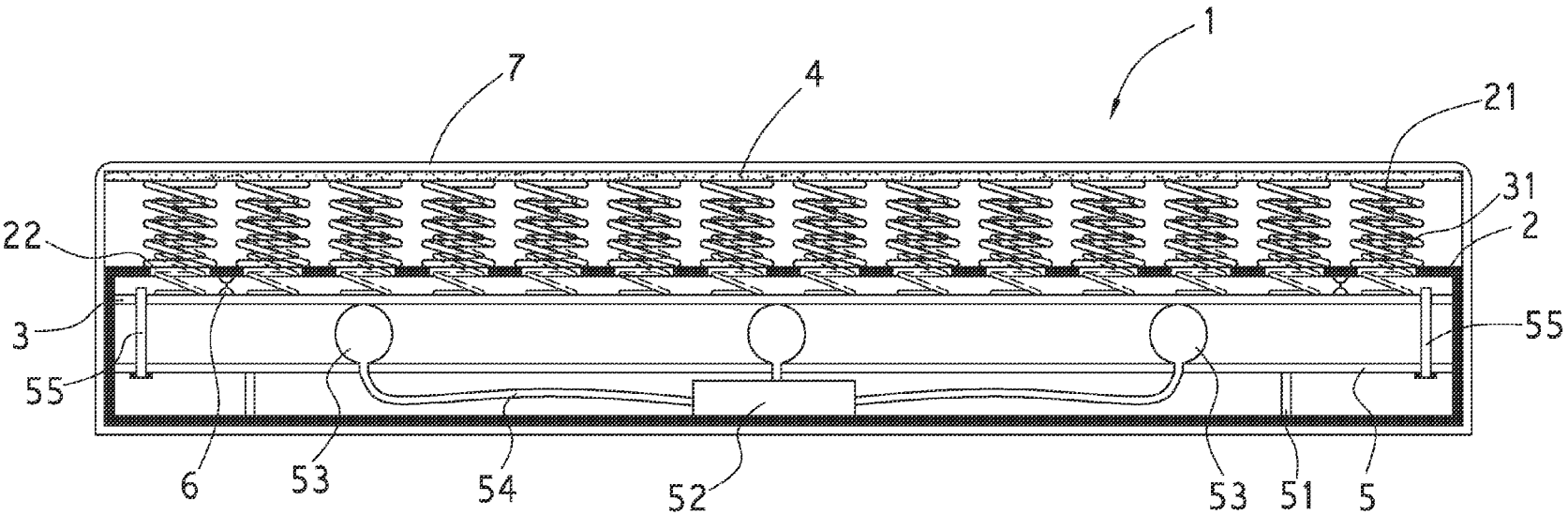
FIG. 5 illustrates a schematic sectional action view of the air bags of the mattress structure able to adjust elastic support forces of the present invention.

With reference to FIG. 5, which illustrate a schematic sectional action view of the air bags of the mattress structure able to adjust elastic support forces of the present invention. While the user demands that the support forces of the mattress structure are promoted, to activate the air bags 52 and then to pump air to the air bags 53 are to move the moving plate 3 up to the fixed plate 2, the second flexible members 31 go through the flexible accommodating holes 22. Meanwhile, not only the first flexible members 21 are to support the user, but also the second flexible members 31 do. Hence, the support forces are enhanced; otherwise, to activate the air compressor 52 to leak the air bags 53 is to lower down the moving plate 3, then the second flexible members 31 are lowered down either so as to make that only the first flexible members 21 support the user. That is, the support forces are decreased.

The distance for the moving plate 3 moving upward can be controlled by the user. The second flexible members 31 of the moving plate 3 can be moved up to ⅓, ½ or ⅔ height of the first flexible member 21 or the equal height or any height of the first flexible member 21. Therefore, the first flexible member 21 may have different lowering depths and different support forces while being compressed by the user.

Figure 6:
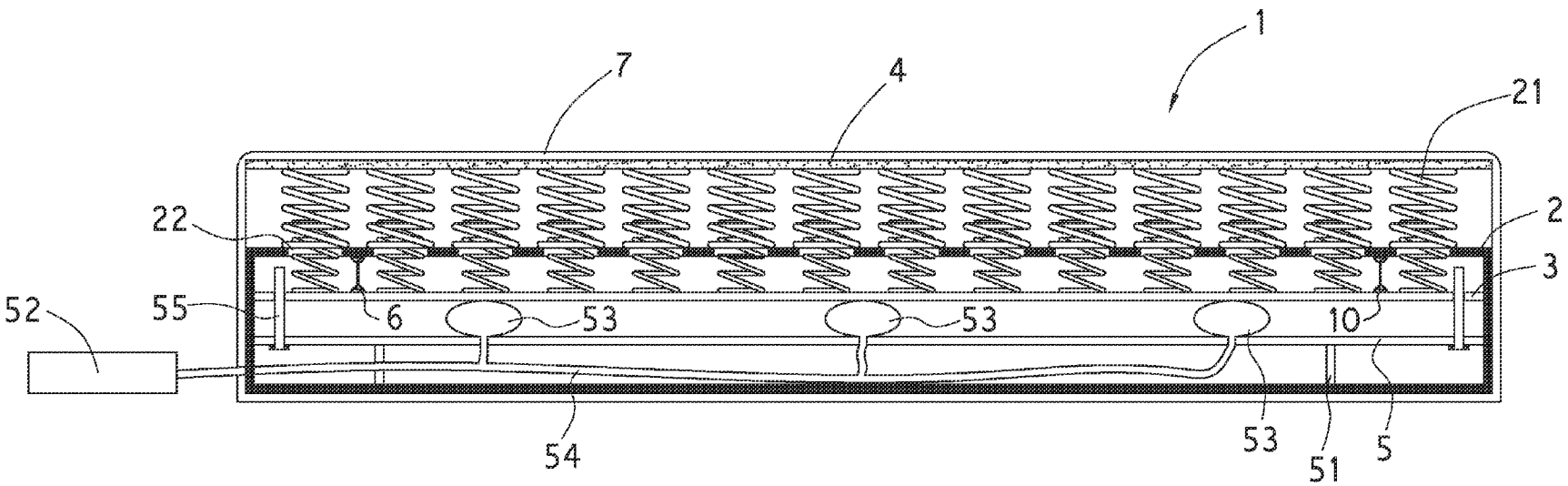
FIG. 6 illustrates a schematic sectional structural view of another preferred embodiment of the mattress structure able to adjust elastic support forces of the present invention.

With reference to FIG. 6, which illustrates a schematic sectional structural view of another preferred embodiment of the mattress structure able to adjust elastic support forces of the present invention. In the preferred embodiment, which structure is the most like the structure of FIG. 5 and not described any further. The only difference is the air compressor 52 is disposed outside of the mattress, then the air compressor 52 is connected with the air bags 53 through the tubes 54 in order to lower down the mattress for decreasing occupied space.

Figure 7:
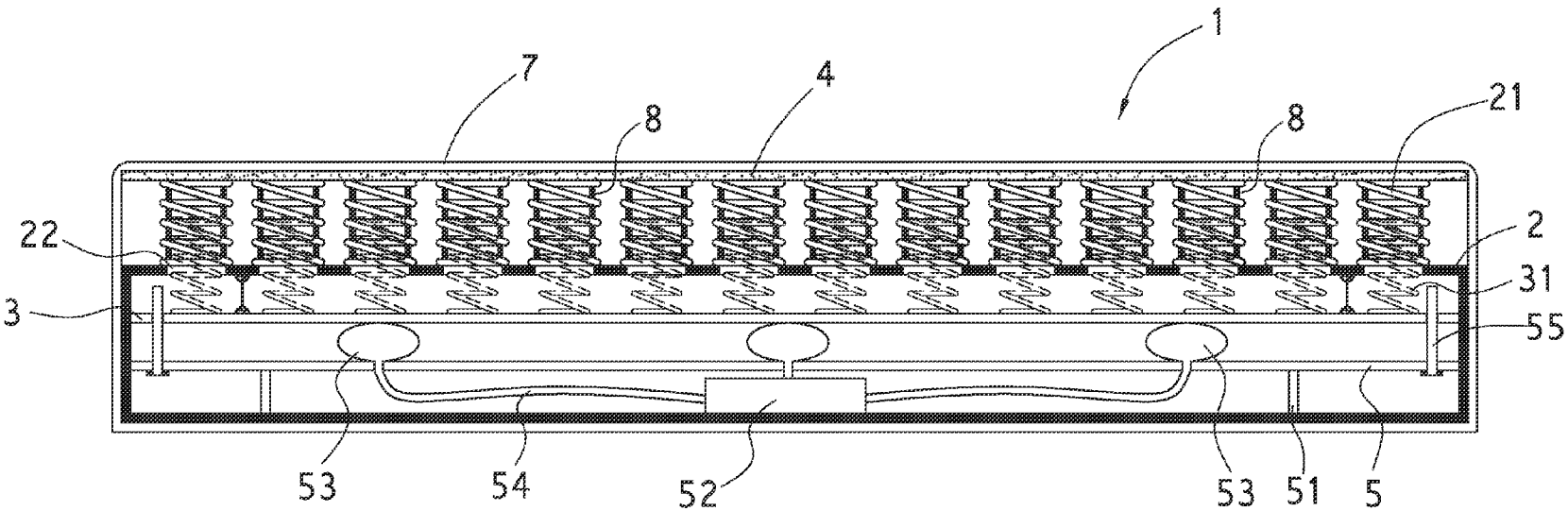
FIG. 7 illustrates a schematic sectional structural view of another preferred embodiment of the mattress structure able to adjust elastic support forces of the present invention.

With reference to FIG. 7, which illustrates a schematic sectional structural view of another preferred embodiment of the mattress structure able to adjust elastic support forces of the present invention. In the preferred embodiment, a guiding member 7 is disposed in a gap between the first flexible member 21 and the second flexible member 31 so as to avoid that an impact of the first flexible member 21 and the second flexible member 31 causes deformations for the first flexible member 21 and the second flexible member 31 due to angle deviations while the second flexible member 31 moves up to the first flexible member 21. Hence, the guiding member 7 guides the moving direction of the second flexible member 31 in order to avoid the deformations of the first flexible member 21 and the second flexible member 31. Further, the guiding member 7 is made of foam.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. A mattress structure able to adjust elastic support forces comprising:

a fixed plate, which has a plurality of flexible accommodating holes and a plurality of first flexible members;

a moving plate, which has a plurality of second flexible members corresponding to the flexible accommodating holes, the moving plate being below the fixed plate and having a distance with the fixed plate for moving; and a support plate, which is below the moving plate and has an air compressor at the bottom thereof, the air compressor having a plurality of air bags disposed between the support plate and the moving plate and a plurality of tubes connecting the air compressor with the air bags, the moving plate being moved up and down through that the air bags pump gas in order to make the second flexible members go through the flexible accommodating holes and be out of the surface of the fixed plate.

2. The mattress structure able to adjust elastic support forces according to claim 1, further comprising a remote control device, which is connected with the air compressor for controlling the air compressor.

3. The mattress structure able to adjust elastic support forces according to claim 1, wherein a gap between the first flexible member and the second flexible member is disposed a guiding member.

4. The mattress structure able to adjust elastic support forces according to claim 1, wherein the support plate has a plurality of fixing pillars, a plurality of fixing pillars being disposed on the moving plate and corresponding to the fixing pillars, the fixing pillars being actively penetrated through the moving plate for the moving plate steadily moving.

5. The mattress structure able to adjust elastic support forces according to claim 1, wherein a height sensor is disposed between the moving plate and the fixed plate and connected with the air compressor, the message of the distance between the moving plate and the fixing plate being delivered to the air compressor for controlling the displacement of the moving plate.

6. The mattress structure able to adjust elastic support forces according to claim 1, wherein the flexible accommodating holes are disposed at the bottom inside the first flexible members.

7. The mattress structure able to adjust elastic support forces according to claim 1, wherein the flexible accommodating holes are disposed between the two first flexible members.

* * * * *